US005274217A

United States Patent [19]

Kilian

[11] Patent Number: 5,274,217

[45] Date of Patent: Dec. 28, 1993

[54] KEYBOARD HAVING KEYS WITH DIFFERENT HEIGHTS

[75] Inventor: Karl L. Kilian, Baiersdorf, Fed. Rep. of Germany

[73] Assignee: Fritz Hartmann Gerätebau GmbH & Co. KG, Baiersdorf, Fed. Rep. of Germany

[21] Appl. No.: 772,938

[22] Filed: Oct. 8, 1991

[30] Foreign Application Priority Data

Oct. 16, 1990 [DE] Fed. Rep. of Germany ... 9014472[U]

[51] Int. Cl.[5] ..... H01H 13/70; G06C 7/02

[52] U.S. Cl. ..... 235/145 R; 200/5 A

[58] Field of Search ..... 200/5 A; 400/488; 235/145 R

[56] References Cited

U.S. PATENT DOCUMENTS

| | | | |
|---|---|---|---|
| 3,803,834 | 4/1974 | Reese | 364/705.07 |
| 3,860,771 | 1/1975 | Lynn et al. | 200/5 A |
| 3,879,586 | 4/1975 | DuRocher et al. | 200/5 A |
| 3,928,960 | 12/1975 | Reese | 364/705.07 |
| 4,128,889 | 12/1978 | Ojima et al. | 200/5 A X |
| 4,974,183 | 11/1990 | Miller | 364/709.12 |
| 5,122,786 | 6/1992 | Rader | 340/711 |

FOREIGN PATENT DOCUMENTS

| | | |
|---|---|---|
| 794054 | 5/1973 | Belgium . |
| 0210973 | 2/1987 | European Pat. Off. . |
| 737039 | 5/1943 | Fed. Rep. of Germany . |

OTHER PUBLICATIONS

Conway, D. L. "Contoured Keyboard," IBM Technical Disclosure Bulletin, vol. 22, No. 3, Aug. 1979, pp. 1276–1277.

*Primary Examiner*—J. R. Scott

*Attorney, Agent, or Firm*—Spencer, Frank & Schneider

[57] ABSTRACT

A keyboard has keys arranged in parallel columns with all of the keys in a respective column projecting from a front plate the same distance. The keys of a first column are arranged to project a smaller distance from the front plate than the keys of an adjacent second column.

21 Claims, 3 Drawing Sheets

KEYBOARD HAVING KEYS WITH DIFFERENT HEIGHTS

CROSS-REFERENCE TO RELATED APPLICATION

The present disclosure relates to the subject matter disclosed in German Application No. G 90 14 472.4 filed Oct. 16, 1990, the entire specification of which is incorporated herein by reference.

BACKGROUND OF THE INVENTION

The present invention relates to a keyboard having at least two parallel columns of keys, and in particular, to a finger-operated mini-keyboard for electrical or electronic devices, wherein the non-depressed keys within one column project the same height from a front plate of the keyboard.

In the course of the increasing miniaturization of electrical or electronic devices, there inevitably arises the requirement for a miniaturized keyboard as well. Primarily, such keyboards are numerical keyboards including 10 keys that are marked with the numbers 0 to 9 of the decimal system. Sometimes additional keys are also provided for special functions. Standard keyboards of this type have evolved which have 12 or 16 keys. In 12-key keyboards, the keys ar arranged in three parallel adjacent columns of four keys each and, in 16-key keyboards, in four parallel adjacent columns of four keys each. The positioning of the keys in the individual columns is such that each key of each column of keys lies on a straight line that extends at a right angle to the direction of the columns and leads to a key of an adjacent column, thereby forming parallel rows. The arrangement of the keys is such that each key lies at the approximate point of intersection of an imaginary straight line of a uniform grid.

The trend toward increasing miniaturization of such keyboards adversely affects the reliability of finger operation.

SUMMARY OF THE INVENTION

It is an object of the present invention to configure such mini-keyboards in such a way that, in spite of a small distance between the individual columns, an operator's finger can reliably depress a selected key. Thus, the inadvertent depression of adjacent keys and, in particular, the simultaneous closing of electrical contacts connected therewith, is avoided.

This object and others to become apparent as the specification progresses, are accomplished by the invention, according to which, briefly stated, a keyboard is provided, wherein the keys of a first column project a smaller distance from the front plate of the keyboard than the keys of a second column.

The problem to which the invention is directed can be solved particularly advantageously by a keyboard having two outer columns of keys which project from the front plate a smaller distance than those of columns which extend therebetween. In order to reliably depress only one key of an outer column of keys so as to close the electrical contact connected therewith, an operator's finger can be oriented so that the fingertip touches and presses the surface of the key obliquely from the outer side, i.e., from the direction away from a central column of keys, and not perpendicularly, i.e., not from directly above the key in the direction of displacement of the key. If a key assigned to a central column of keys is to be depressed, the operator's fingertip can be placed and pressed perpendicular to the key depression surface in the direction of displacement of the key. Due to the fact that the keys assigned to a central column of keys project a larger distance, i.e., to a greater height, their closed position can be designed to lie at a height at which the operator's fingertip has not yet touched an adjacent key that is assigned to an outer column of keys, or at least has not yet displaced it in such a manner that an undesirable electrical closure is established there.

DETAILED DESCRIPTION OF THE PREFERRED EMBODIMENTS

The 12-keyboard of FIGS. 1–4 includes 12 keys 1 arranged in three equidistant parallel columns 2, 3 and 4. The keys 1 in columns 2, 3 and 4 project from a planar front plate 5 approximately perpendicular to its surface.

Figure 3:
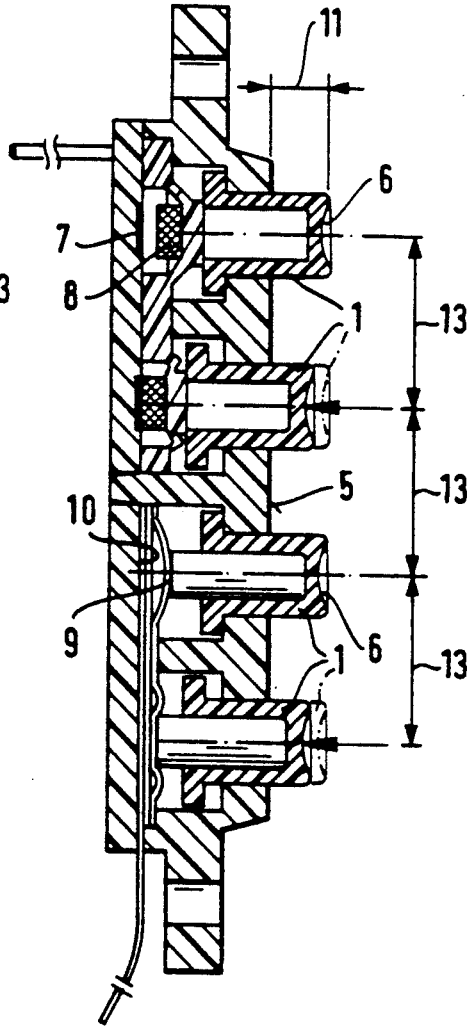
FIG. 3 is a sectional view along line III—III of FIG. 1, with several types of electrical contacts being shown that can be closed by the keys to establish an electrical path.
Figure 4:
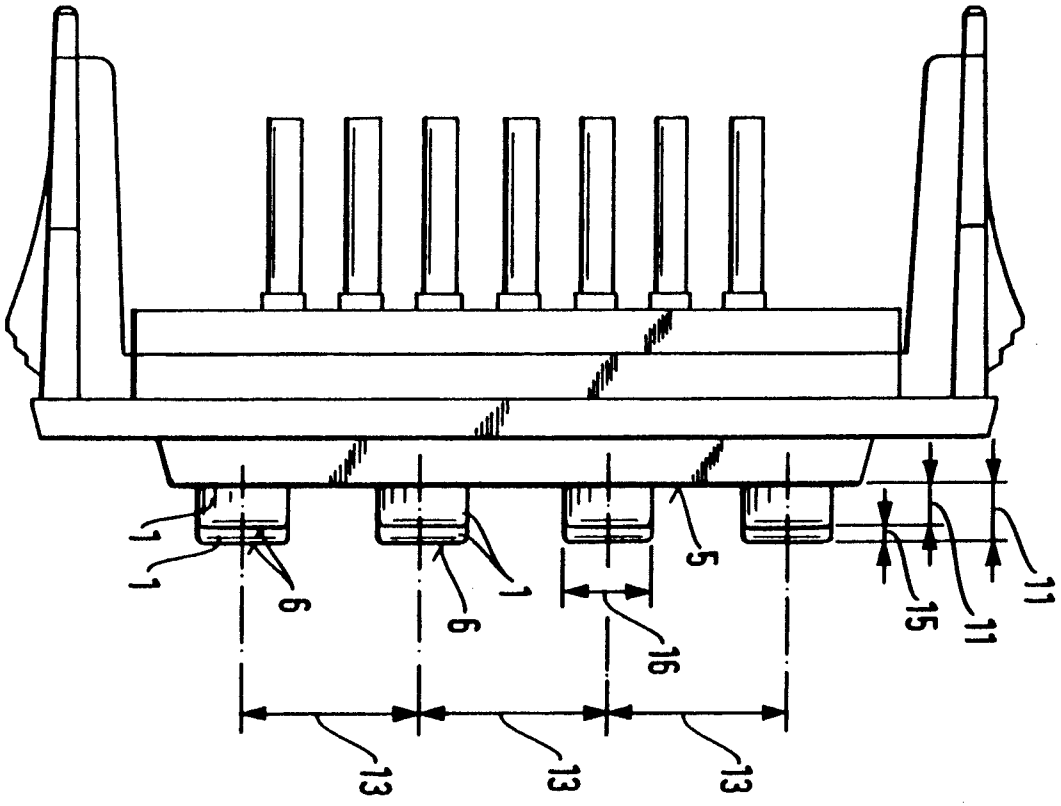
FIG. 4 is a side elevational view of the keyboard of FIG. 1 along arrow IV of FIG. 1.

The pressure surfaces 6 of keys 1 are provided with symbols in a conventional manner, including the numbers "0" to "9", so as to facilitate their selection. In FIG. 3, the keys 1 bearing the symbols "2" and "8" are shown in a non-depressed state and the keys 1 bearing the symbols "5" and "0" are shown in a depressed state. In the non-depressed state as shown, there is no physical contact between electrical contacts 7, 8 and 9, 10, respectively. These contacts are in a normally open position and are closed by depressing keys 1.

Figure 2:
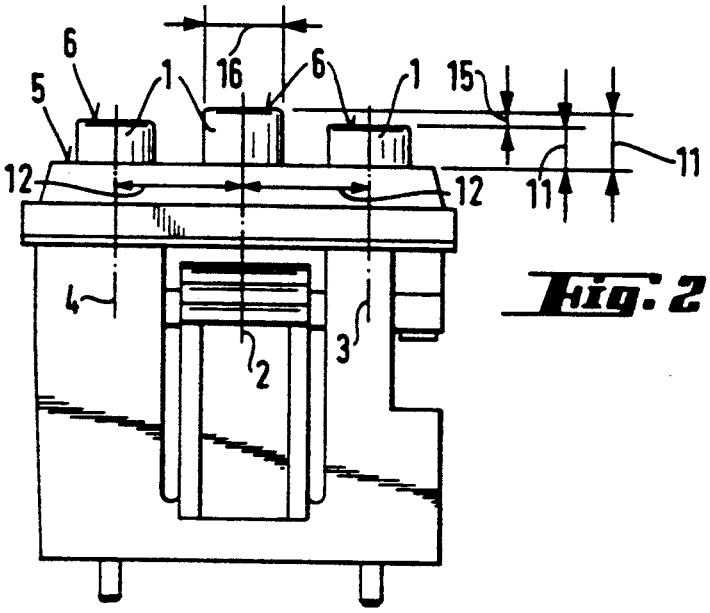
FIG. 2 is an end elevational view of the keyboard of FIG. 1 in the direction of arrow II of FIG. 1.

Each of the (non-depressed) keys 1 in a respective column project beyond the plane of front plate 5 at approximately the same height 11. However, the projection height 11 of the keys 1 of the center column 2 is greater than the projection height 11 of the keys 1 of the two outer columns 3 and 4 in this embodiment, as seen in FIG. 2.

The distance of the centers of adjacent key columns from one another 12 is smaller than the distance 13 between the centers of adjacent keys 1 in the same key column.

Figure 1:
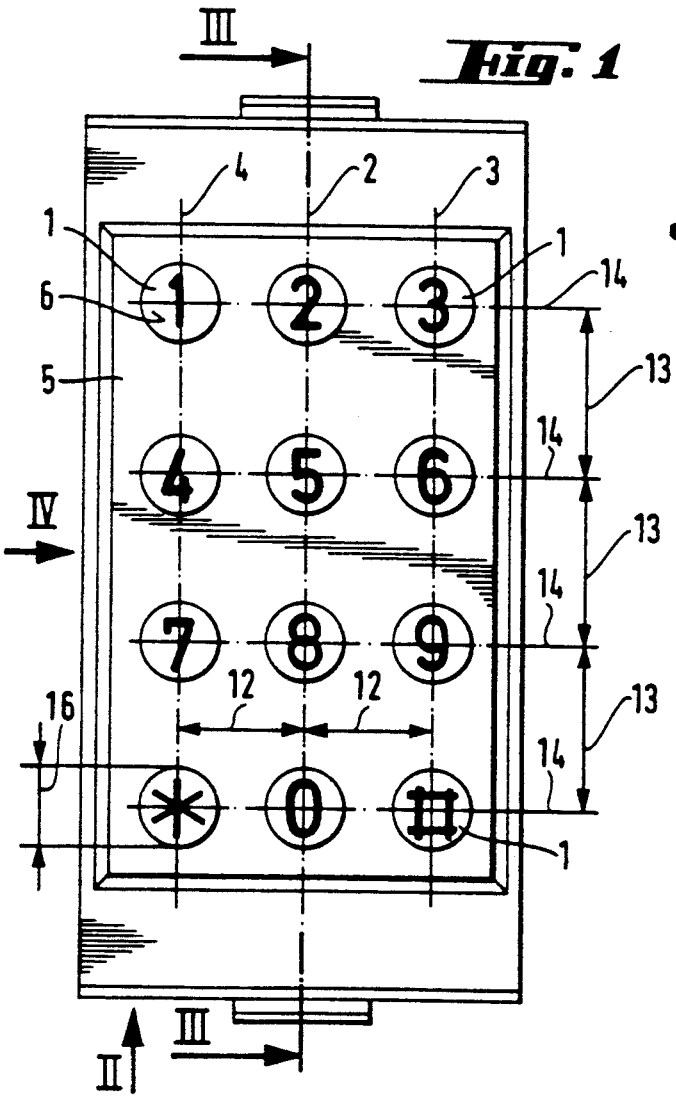
FIG. 1 is a top plan view of a 12-key keyboard according to an embodiment of the invention.

In particular, the keys 1 of adjacent key columns 2, 3 and 4 are positioned next to one another in parallel rows aligned with straight directional lines 14 that extend through the centers of keys in a row at a right angle to the direction II of the key columns. The keys in columns 2, 3 and 4 therefore form a grid, as seen in FIG. 1, and the distance 12 between the centers of keys of adjacent columns is about 70% to 80% of the distance 13 between the centers of keys of adjacent rows, i.e., 70% to 80% of the distance between directional lines 14.

The approximate height difference 15 between the projection height 11 of a center column of keys 2 and that of an outer column of keys 3 or 4, respectively, is preferably at least 0.5 mm.

In the illustrated embodiment, the distance 12 between the centers of keys in adjacent columns is 4.7 mm, and the cylindrical keys have a diameter 16 of 3 mm. The distance 13 between the centers of keys in a particular column, i.e., between the centers of adjacent keys in a row, is 6 mm.

Figure 5:
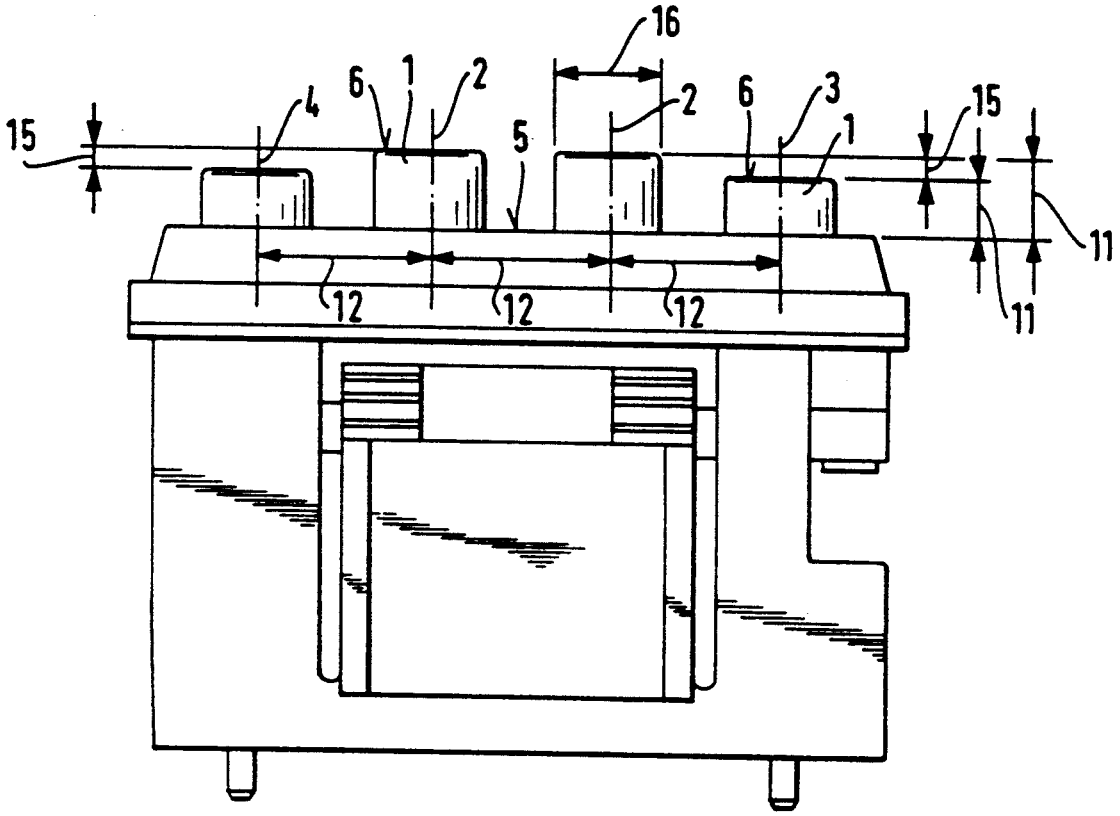
FIG. 5 is an end elevational view of a 16-key keyboard according to another embodiment of the invention.

In the embodiment illustrated in FIG. 5, there are four parallel columns having four keys each forming a 16-key keyboard. In this embodiment, the projection height 11 of the keys 1 of the two center columns 2 is greater than the projection height 11 of the keys 1 of the two outer columns of keys 3 and 4.

It will be understood that the above description of the present invention is susceptible to various modifications, changes and adaptations, and the same are intended to be comprehended within the meaning and range of equivalents of the appended claims.

What is claimed is:

1. In a keyboard having a front plate and keys arranged in parallel columns extending therethrough; all of the keys in a respective column projecting through the front plate the same distance; the improvement wherein the keys of a first column project a smaller distance through the front plate than the keys of a second column.

2. A keyboard as defined in claim 1, wherein the keyboard is a finger operated mini-keyboard for electrical or electronic devices, said smaller distance is at least 0.5 mm smaller, a distance between centers of keys in adjacent columns is 4.7 mm, said keys are cylindrical and have a diameter of 3 m, and a distance between centers of said keys in a column is 6 mm.

3. A keyboard as defined in claim 1, wherein the front plate is planar.

4. A keyboard as defined in claim 1, wherein the distance between adjacent columns is smaller than the distance between adjacent keys in a column.

5. A keyboard as defined in claim 4, wherein keys of adjacent columns are positioned next to one another in rows that extend at a right angle to the direction of the columns.

6. A keyboard as defined in claim 5, wherein the distance between adjacent columns is approximately 70% to 80% of the distance between adjacent rows.

7. In a keyboard having a front plate and keys arranged in a plurality of parallel columns extending therethrough, including two outer columns and at least one column extending therebetween; all the keys in a respective column projecting through the front plate the same distance; the improvement wherein the keys of the outer columns project a smaller distance through the front plate than keys of said at least one column extending therebetween.

8. A keyboard as defined in claim 7, wherein there are three columns each having four keys.

9. A keyboard as defined in claim 7, wherein the number of columns is four and the number of keys is four for each column.

10. A keyboard as defined in claim 7, wherein the distance between adjacent columns is smaller than the distance between adjacent keys in a column.

11. A keyboard as defined in claim 10, wherein keys of adjacent columns are positioned next to one another in rows that extend at a right angle to the direction of the columns.

12. A keyboard as defined in claim 11, wherein the distance between adjacent columns is approximately 70% to 80% of the distance between adjacent rows.

13. A keyboard as defined in claim 7, wherein the smaller distance is at least 0.5 mm smaller.

14. A keyboard as defined in claim 7, wherein the front plate is planar.

15. A keyboard as defined in claim 7, wherein the keyboard is finger operated mini-keyboard for electrical or electronic devices.

16. A keyboard as defined in claim 5, wherein the keyboard is a finger operated mini-keyboard for electrical or electronic devices, said smaller distance is at least 0.5 mm smaller, a distance between centers of keys in adjacent columns is 4.7 mm, said keys are cylindrical and have a diameter of 3 mm, and a distance between centers of said keys in a column is 6 mm.

17. A keyboard comprising:

a planar front plate; and a plurality of keys extending through said front plate and arranged in at least two parallel columns, keys arranged in a first one of said at least two columns extending through said planar front plate a greater distance than keys arranged in an adjacent one of said at least two columns.

18. The keyboard according to claim 17, wherein the at least two parallel columns of keys comprise three columns, the first one of said columns is disposed between and adjacent to second and third ones of said columns, and the keys arranged in the first one of said columns extend through said planar front plate a greater distance than keys arranged in said adjacent second and third columns.

19. The keyboard according to claim 17, wherein the at least two parallel columns of keys comprise three parallel columns of four keys each, the plurality of keys comprises twelve cylindrical keys extending along axes thereof through said front plate in a direction opposite to an actuating direction and arranged in said three parallel columns in three parallel rows, the first one of said columns is disposed between and adjacent to second and third ones of said columns, and the keys arranged in the first one of said columns extend through said planar front plate a greater distance than keys arranged in said adjacent second and third columns.

20. The keyboard according to claim 17, wherein the at least two parallel columns of keys comprise four parallel columns of four keys each, the plurality of keys comprises sixteen cylindrical keys extending along axes thereof through said front plate in a direction opposite to an actuating direction and arranged in said four parallel columns in four parallel rows, the first one and a second one of said columns are disposed adjacent to one another, third and fourth ones of said columns are disposed adjacent to said first and second ones of said columns, respectively, and the keys arranged in the first and second one of said columns extend through said planar front plate a greater distance than keys arranged in said third and fourth columns.

21. A finger operated mini-keyboard for electrical or electronic devices comprising:

a front plate; and a plurality of operator keys arranged in at least three juxtaposed and parallel rows of keys that project from the front plate, wherein non-depressed operator keys of a respective row of keys each project from the front plate at the same projection height, wherein non-depressed operator keys of an outer row of keys have a lower projection height than non-depressed operator keys of a center row of keys, and wherein the center row of keys has a projection height configured so that the operator keys associated therewith each reach their contact position at a height level at which the fingertip of an operating finger does not displace any operator key of one of the other rows of keys in such a manner that contact takes place.

* * * * *